United States Patent [19]
Bates
[11] 4,356,028
[45] Oct. 26, 1982

[54] IN SITU PHOSPHORUS ADDITION TO TANTALUM

[75] Inventor: Victor T. Bates, Kenosha, Wis.
[73] Assignee: Fansteel Inc., North Chicago, Ill.

[21] Appl. No.: 295,250
[22] Filed: Aug. 24, 1981
[51] Int. Cl.[3] ..... B22F 9/24
[52] U.S. Cl. ..... 75/0.5 AB; 75/0.5 BB; 75/84.4
[58] Field of Search ..... 75/0.5 BB, 0.5 AB, 84.4

[56] References Cited

U.S. PATENT DOCUMENTS 3,825,802 7/1974 Kumugai .
3,829,310 8/1974 Mahy ..... 75/0.5 BB
4,009,007 7/1975 Fry .
4,017,302 4/1977 Bates et al. ..... 75/0.5 BB
4,149,876 4/1979 Rerat ..... 75/0.5 BB

FOREIGN PATENT DOCUMENTS 55-113807 9/1980 Japan .

*Primary Examiner*—W. Stallard
*Attorney, Agent, or Firm*—Dressler, Goldsmith, Shore, Sutker & Milnamow, Ltd.

[57] ABSTRACT

During the method of preparing tantalum powder from a tantalum rich solution in an organic solvent in which a tantalum salt is precipitated from the tantalum rich solvent and the tantalum salt is reduced to metalic tantalum by an alkali metal, a phosphorus-containing material is added to either the precipitated step or the reduction step or both.

12 Claims, No Drawings

IN SITU PHOSPHORUS ADDITION TO TANTALUM

FIELD OF THE INVENTION

This invention relates to tantalum powder and particularly to a method for preparing tantalum powders which can be fabricated to anodes of improved electrical capacitance.

BACKGROUND OF THE INVENTION

The use of tantalum powders for the preparation of electrodes in electrolytic capacitors is well-known. Such electrodes are made by pressing the tantalum powder to form a coherent compact, sintering the compact and subsequently forming a dielectric film on the sintered product.

In such capacitors it is desired to have as high a specific capacity CV/g. as possible. U.S. Pat. No. 3,418,106 discloses an agglomerated tantalum powder crushable as tantalum which when fabricated into an electrode provides enhanced specific capacity in pressed and sintered anodes. The agglomerated tantalum powder described in this patent also has improved flow characteristics as compared to prior powders.

U.S. Pat. No. 3,825,802 discloses improvements in various properties of tantalum capacitors, including specific capacity, by the addition to the tantalum of any of several "dopants", including phosphorus. The range of dopant disclosed is from 0.47 to 2.71 atomic percent which, for phosphorus is equivalent to from about 800 to 4600 parts per million and the improvement in specific capacity (for nitrogen, the preferred species) ranges from about 2% (at the lower end of the range) to about 6.3% (at the upper end) when the anode is sintered at 1900° C.

U.S. Pat. No. 4,009,007, issued to Stanley S. Fry on Feb. 22, 1977 and coassigned herewith, discloses that tantalum powders, to which a small amount of a phosphorus-containing material has been added, produce anodes having improved capacitance values.

The Fry patent states (col. 1, lines 57 to 62) "[w]hen phosphorus is present in a tantalum powder as on incidental impurity, either carried over from the original ore or introduced as an impurity in the chemicals used in the normal preparation of the tantalum powder, the results of this invention are not obtained."

The basis for the foregoing statement was the fact that among tantalum powders to which no phosphorus had been added, no significant difference in specific capacity was observed between those which showed a small amount of phosphorus content on analysis and those which showed substantially none.

SUMMARY OF THE INVENTION

It has now been found that a tantalum powder capable of producing anodes of improved specific capacity may be prepared by adding a small amount of a phosphorus-containing material to a tantalum-containing precursor of the tantalum powder.

In a conventional preparation of metallic tantalum from a tantalum-containing material, such as a tantalum ore, the ore is first treated with hydrofluoric acid to dissolve tantalum values and other materials in a hydrofluoric acid solution. The hydrofluoric acid solution is then extracted with methyl isobutyl ketone in a liquid-liquid solvent extraction process to remove gangue materials and leave the tantalum values in the raffinate.

The addition of potassium fluoride to the aqueous raffinate then results in the precipitation of the tantalum values as the potassium tantalum fluoride ($K_2TaF_7$) salt. The last named salt is then reduced by liquid sodium, preferably by the method disclosed in coassigned U.S. Pat. No. 4,149,876, issued to Carlos F. Rerat on Apr. 17, 1979.

In place of ores, other tantalum-containing materials may be used as starting materials, including tin slags and residues, and natural and artificial concentrates of these materials, and also including scrap metal products made of tantalum and tantalum base alloys and other alloys in which the tantalum may be associated with other metals and alloys.

In one embodiment of this invention a phosphorus-containing material is added to the hydrofluoric acid solution of tantalum (raffinate) after the liquid-liquid solvent extraction and before, or at the time that, the tantalum is precipitated, crystallized or otherwise recovered as a compound therefrom. In another embodiment of this invention a phosphorus containing material is added to the precipitated tantalum salt ($K_2TaF_7$) before, or at the time that the tantalum salt is reduced to metallic tantalum in the form of a powder. The recovery of tantalum in the compound $K_2TaF_7$ is exemplary of this invention. However, it will be apparent to those skilled in the art that the addition of a phosphorus-containing material can be made during or subsequent to the preparation of other tantalum compounds. Such other tantalum compounds, prepared by processes known in the art, include tantalum hydroxide, tantalum oxide, sodium tantalate, tantalic acid and halides of tantalum, particularly tantalum pentachloride.

The amount of phosphorus-containing material added to the tantalum-containing solution, or tantalum-containing precipitate, in accordance with this invention is equivalent to at least 5 parts per million of elemental phosphorus per million parts of elemental tantalum at the step of said addition and sufficient to provide from about 2 to about 400 parts per million parts of elemental phosphorus in the reduced powder. At phosphorus levels above about 400 parts per million in the reduced powder, a plateau is reached and further improvement in specific capacity values are not obtained. Furthermore, phosphorus additions in excess of about 400 parts per million based on elemental phosphorus adversely affect the green strength of anodes pressed from the powder and adversely affect its properties after sintering.

Some of the phosphorus-containing material added to the tantalum-containing solution, or tantalum-containing precipitate, does not carry over to the reduced tantalum powder product, resulting in a lower phosphorus content in the powder than the amount added at the early stage. The amount of phosphorus-containing material which must be added to provide a desired level in the reduced tantalum powder product is dependent on the nature of the phosphorus-containing material and the conditions of treatment after the addition thereof. The amount to be added can be determined from prior runs with the same phosphorus-containing additive and same processing conditions and generally involves adding an excess of the phosphorus-containing material to achieve the desired final amount, based on any losses of phosphorus.

The preferred phosphorus-containing materials are the inorganic phosphate salts, such as ammonium, sodium, potassium, calcium, barium and lead orthophosphate, ammonium mono-hydrogen orthophosphate, ammonium di-hydrogen orthophosphate, sodium mono-hydrogen orthophosphate, sodium di-hydrogen orthophosphate, and potassium di-hydrogen orthophosphate. Other suitable phosphorus-containing materials include barium and lead orthophosphate, elemental phosphorus, metallic phosphides, phosphorus oxides and acids, and organic phosphorus-containing materials, such as alkyl phosphates.

Phosphate materials containing no metallic cations, such as ammonium mono-hydrogen orthophosphate, ammonium dihydrogen ortho phosphate and phosphoric acid, are particularly preferred because they do not introduce other metals into the tantalum powder with possible adverse effects on the d.c. leakage and breakdown voltage properties of the anodes produced therefrom.

The phosphorus-containing material, when added to the tantalum compound, may be a finely divided solid material which is suspended in the tantalum-containing solution or mixed into the tantalum-containing precipitate. The phosphorus-containing material may also be added as an aqueous solution to the tantalum-containing solution to be precipitated together with the tantalum-containing material, or precipitated after the tantalum-containing material by another precipitant.

The reduced tantalum powder containing a phosphorus-containing material, added during the production of the reduced powder, as described above, may if desired have additional phosphorus added after reduction, as described in U.S. Pat. No. 4,009,007. However, to fall within the ambit of the present invention, the phosphorus-containing material added during the production of the reduced powder must constitute at least 5 parts (as elemental phosphorus) per million parts of tantalum and must produce a powder which contains (before the later phosphorus addition) from about 2 to about 400 parts of phosphorus-containing material (as elemental phosphorus) per million parts of tantalum.

The phosphorus-containing tantalum powder produced in accordance with the invention may be agglomerated, if desired, as described in U.S. Pat. No. 3,418,106; and whether agglomerated or unagglomerated, it is contemplated that it will be pressed and sintered to form anodes of high specific capacity by techniques known in the art.

When phosphorus is added to a tantalum compound, in accordance with the method of this invention, prior to the formation of tantalum powder from the compound the resultant powder has been found to have a higher specific capacity at a given phosphorus level than a similarly prepared tantalum powder to which the phosphorus has been added to an already made tantalum powder, or tantalum hydride powder. Lower phosphorus levels for the same degree of specific capacity improvement tends to reduce D.C. leakage and is therefore advantageous.

EXAMPLE 1

This example describes the results on the final tantalum powder of phosphorus additions made during a sodium reduction process to produce tantalum metal powder from a potassium tantalum fluoride salt, $K_2TaF_7$. The apparatus used for conducting the series of sodium reduction runs for this example is described in (Rerat) U.S. Pat. No. 4,149,876, assigned to the same assignee, which patent is incorporated by reference.

In run A, quantities of 1000 lbs. of $K_2TaF_7$ and 960 lbs. of NaCl were charged into a reaction vessel. A phosphorus addition of about 100 g $Na_2HPO_4$ was made to this reaction mix, which corresponded specifically to a calculated phosphorus addition of 104 ppm on a tantalum metal basis. The closed vessel and its charge were heated to melt the charge. The agitator was started and an agitator speed of 120 rpm was maintained thereafter to homogenize the liquid bath. Sodium additions were begun at approximately 650° C. at a feed rate in the range of 12.5 to 15.5 lbs. per min. for a time of 11 min. for a total consumption of 150 lbs. During this initial period, when a temperature of 700° C. was reached a blower providing 1500 cfm of air was used to provide external fan cooling to the vessel. The remainder of 148 lbs. of sodium was then fed at a relatively steady rate for a time of 35 min. to complete the reaction.

The reaction mass was cooled to ambient temperature and the tantalum metal powder was recovered from the frozen mass by crushing and leaching, as is known in the art.

The tantalum powder was analyzed for chemical composition by conventional procedures, including mass spectrographic analysis for phosphorus and residual elements. The percent by weight of +80 mesh, −80+120 mesh, −120+200 mesh, −200+325 mesh and −325 mesh material was determined by sieve analysis using U.S. Standard screens. The −80 mesh portions were combined, blended and used for all other tests.

The particle size of this powder was measured as Fisher sub-sieve (FSSS) in accordance with ASTM designation B330-65, "Standard Method of Test for Average Particle Size of Refractory Metals and Compounds by the Fisher Sub-sieve Sizes." The average FSSS of the as-reduced powder was 2.45 uM. Apparent density, hereafter called "Scott density" (SD), was determined on the powder by the procedure of ASTM designation B212-48 (Reapproved 1970), "Standard Method of Test for Apparent Density of Metal Powders."

The chemical analysis, sieve analysis, FSSS and SD data are listed in Column A of TABLE I hereinbelow.

A portion of the −80 mesh powder was tested for green strength and electrical properties in the "as-reduced" condition. A second portion of the −80 mesh powder was heated in a vacuum of about $10^{-3}$ torr absolute pressure to about 1350° C. (optical temperature), held for 1 hr. at temperature, cooled under vacuum for 2 hrs. and finally under helium to ambient temperature, then milled and screened using a 35 mesh screen, with any oversize material remilled and rescreened so that all powder was −35 mesh. This tantalum powder is referred to as "thermally agglomerated" powder produced according to the teachings of (Pierret) U.S. Pat. No. 3,473,915.

Portions of each type of powder were pressed into individually weighed 2.010+0.020 gram compacts in a 0.261 inch diameter die to green densities of 4.5 (thermally agglomerated powder only), 5.0 and 5.5 g/cm$^3$ for determination of green strength as a function of pressed density. Efforts to press compacts of the "as-reduced" powder at a green density of 4.5 g/cm$^3$ were unsuccessful because the green strengths were too low and inadequate for handling. The compacts were each individually laid sideways under the anvil of a Chatillon Model LTCH Universal Tensile, Compression and Spring Tester provided with a flat anvil and base, and were crushed at a compression rate setting of 2.0. The pressure in pounds required to crush the compact was recorded as the green strength. Four compacts were tested for green strength, and the data were averaged. In this test, if any compact has a value that is an outlier as determined in accordance with ASTM E178-61T, an additional anode was pressed and tested. (An outlying observation, or outlier, was one that appeared to deviate markedly from other members of the set in which it occurred.) The green strength data are shown in Column A of TABLE II, hereinbelow.

Each type of powder was individually weighed and pressed into 1.0 gram compacts or anodes with an embedded tantalum lead wire in a 0.213 inch diameter die to green densities of 5.5 and 6.5 g/cm$^3$.

One group of the anodes pressed to each of these densities was sintered for 30 min. at 1600° C. (optical temperature) in a cold-wall, vacuum sintering furnace ($10^{-5}$ torr absolute pressure). Another group was similarly sintered for 30 min. at 1800° C. (optical temperature).

The percent shrinkage in diameter was determined.

The electrical testing procedure involved anodizing the sintered anodes in 0.1% phosphoric acid in water at an electrolyte temperature of 90° C. Anodizing of the anodes was carried out at a current density of 35 milliamps per gram until 100 volts was reached, and then they were held for 2 hours at 100 volts. The anodized anodes were washed in a deionized water and then dried in clean air at 105° C.

Direct current leakage (DCL) was measured at a test voltage of 70 volts in 10% phosphoric acid. The anodes were immersed in the test solution to the top of the anode and the test voltage was applied for 2 minutes, after which the DCL was measured.

After DCL measurements were completed, the anodes were soaked in 10% phosphoric acid for 30 to 45 minutes.

The capacitance was measured on the anode immersed in 10% phosphoric acid employing a type 1611 B General Radio Capacitance Test Bridge with an a.c. signal of 0.5 volts and a d.c. bias of 3 volts. The dissipation factor also was determined from this bridge test.

The average values for shrinkage during sintering, DCL, specific capacitance (CV/g or ufv/g), and dissipation factor for both the "as-reduced" and the "thermally agglomerated" powders are summarized in Column A of TABLE III, hereinbelow.

Six additional anodes, each weighing 1.0±0.05 grams, were pressed in a 0.213 inch diameter die to a green density of 6.5 g/cm$^3$ then were similarly vacuum sintered for 30 min. at 1650° C. (optical temperature). Breakdown voltage tests were conducted on these anodes by electroforming in an agitated ethylene glycol-water-phosphoric acid solution at 83±0.2 C, with the forming voltage being increased at a rate of 2 volts per minute until dielectric breakdown occurred. This anodizing electrolyte consists of a solution of 55% iron-free ethylene glycol, 45% de-ionized water, and sufficient phosphoric acid to obtain a resistivity of 350±50 ohm-cm at 83° C. The point of breakdown is established when the forming current of the anode increases to 50 milliamperes (m.a.) over the current flowing at 100 volts or when scintillation occurs. The mean breakdown voltage is determined after elimination of "outliers" as defined in a standard test procedure. The mean breakdown voltage for Run A is shown in TABLE IV, hereinbelow.

The above described sodium reduction process and test procedures were used for the other tantalum powders subsequently described herein except for the specific exceptions noted.

In Run B the phosphorus addition made to the reaction mix was about 25 g $Na_2HPO_4$, and corresponded specifically to a calculated phosphorus addition of 26 ppm on a tantalum metal basis. The FSSS of the resulting −80 mesh as-reduced powder was 3.21 uM.

In Run C, the conditions were essentially identical to those of Run B. The FSSS of the as-reduced −80 mesh powder was 3.18 uM, illustrating the reproducibility that can be achieved by the process of this invention.

Run D was a control in which no addition of phosphorus was made, and the specific sodium reduction parameters were adjusted to achieve −80 mesh as-reduced powder with a FSSS of 2.37 uM. Run D was prepared and tested in order to compare the phosphorus-containing product from Run A with a control at essentially the same nominal as-reduced particle size of 2.4 uM as expressed by FSSS and within the limits of the test procedure itself.

Run E was also a control in which no addition of phosphorus was made, and the specific sodium reduction parameters were adjusted to achieve a −80 mesh as-reduced powder with a FSSS of 3.21 uM. Thus the powder from control Run E provides a comparison with the phosphorus-doped product from Runs B and C at essentially the same nominal particle size of 3.2 uM as expressed by FSSS.

The test results determined on the powder from Runs B through E are incorporated along with those for Run A in TABLES I through IV.

TABLE 1

PHYSICAL PROPERTIES AND CHEMICAL COMPOSITIONS OF AS-REDUCED POWDERS OF EXAMPLE 1

| Run No. | A | B | C | D | E |
|---|---|---|---|---|---|
| Sieve Analysis, % | | | | | |
| +80 Mesh | 0.3 | 10.1 | 1.1 | 0.7 | 7.4 |
| −80 + 120 Mesh | 1.7 | 6.2 | 2.8 | 2.8 | 3.2 |
| −120 + 200 Mesh | 5.6 | 7.7 | 11.6 | 11.3 | 8.1 |
| −200 + 325 Mesh | 12.4 | 9.2 | 17.7 | 16.9 | 12.9 |
| −325 Mesh | 80.0 | 66.7 | 66.7 | 68.1 | 68.1 |
| FSSS, μM (−80 Mesh) | 2.45 | 3.21 | 3.18 | 2.37 | 3.21 |
| Scott Density, g/in$^3$ | 37.1 | 40.4 | 34.7 | 29.8 | 43.2 |
| Chemical Analysis, ppm | | | | | |
| $O_2$ | 1330 | 1115 | 1015 | 1489 | 1180 |
| C | 11 | 13 | 10 | 5 | 13 |
| $N_2$ | 24 | 28 | 38 | 50 | 44 |
| Fe | 23 | 29 | 26 | 27 | 20 |
| Ni | 10 | 37 | 84 | 31 | 53 |
| W | 50− | 50− | 50− | 50− | 50− |
| Cr | 10− | 10− | 10− | 10− | 15 |
| Si | 10− | 10− | 10− | 10− | 10− |
| Ca | 5− | 5 | 5− | 10 | 5− |
| Cu | 10 | 11 | 13 | 10− | 12 |
| Nb, V, Mo, Al, Ti, Zr Co, Mg, Sn, Pb, Mn, Zn | 10− | 10− | 10− | 10− | 10− |
| P added (on Ta metal basis) | 104 | 26 | 26 | 0 | 0 |
| P retained (on Ta metal basis) | | | | | |
| As-reduced −80 Mesh | 19 | 2 | 2 | NA* | NA |
| Thermally-agglomerated −35 Mesh | 11 | 7 | 4 | NA | NA |

*NA - not added

TABLE II

GREEN STRENGTH OF AS-REDUCED AND THERMALLY-AGGLOMERATED POWDERS OF EXAMPLE 1

| Pressed Density, g/cm³ | Green Strength, lb., Run No. A | B | C | D | E |
|---|---|---|---|---|---|
| | As-Reduced Powder | | | | |
| 5.0 | 2.4 | ND* | 2.4 | 0.9 | 1.9 |
| 5.5 | 4.1 | ND | 4.1 | 2.6 | 5.5 |
| | Thermally Agglomerated Powder | | | | |
| 4.5 | 5.8 | 5.1 | 10.5 | 13.1 | 7.9 |
| 5.0 | 12.0 | 10.5 | 20.0 | 23.8 | 14.5 |
| 5.5 | 20.0 | 20.0 | 32.0 | 42.0 | 24.3 |

*ND — not determined

TABLE III

ELECTRICAL PROPERTIES OF AS-REDUCED AND THERMALLY AGGLOMERATED POWDERS OF EXAMPLE 1

| Test Conditions: Sintering Temp., °C. | Pressed Density, g/cm³ | Electrical Property | Run No. A | B | C | D | E |
|---|---|---|---|---|---|---|---|
| | | As-Reduced Powder | | | | | |
| 1600 | 5.5 | Sp. Capacity, μfv/g | 11,397 | 9611 | 9859 | 8908 | 8712 |
| ↓ | ↓ | DCL, μa/g | 2.27 | 7.36 | 6.83 | 2.33 | 2.37 |
| ↓ | ↓ | Dissipation Factor, % | 52.95 | 42.2 | 44.0 | 49.08 | 40.85 |
| ↓ | ↓ | Shrinkage in Dia., % | 5.04 | 4.65 | 4.26 | 8.3 | 6.98 |
| 1600 | 6.5 | Sp. Capacity, μfv/g | 11,540 | 8976 | 9087 | 8475 | 8171 |
| ↓ | ↓ | DCL, μa/g | 3.49 | 5.02 | 3.01 | 2.12 | 1.88 |
| ↓ | ↓ | Dissipation Factor, % | 58.5 | 39.55 | 39.60 | 43.5 | 37.3 |
| ↓ | ↓ | Shrinkage in Dia., % | 4.65 | 4.26 | 3.68 | 5.43 | 6.01 |
| 1800 | 5.5 | Sp. Capacity, μfv/g | 6334 | 6088 | 5935 | 5046 | 5366 |
| ↓ | ↓ | DCL, μa/g | 1.78 | 2.33 | 3.98 | 2.43 | 1.92 |
| ↓ | ↓ | Dissipation Factor, % | 20.96 | 24.3 | 23 56 | 31.25 | 22.47 |
| ↓ | ↓ | Shrinkage in Dia., % | 11.24 | 10.66 | 10.27 | 14.15 | 12.21 |
| 1800 | 6.5 | Sp. Capacity, μfv/g | 5711 | 5770 | 5368 | 4550 | 4813 |
| ↓ | ↓ | DCL, μa/g | 2.48 | 15.29 | 6.44 | 2.12 | 2.68 |
| ↓ | ↓ | Dissipation Factor, % | 26.2 | 19.06 | 18.80 | 24.8 | 21.32 |
| ↓ | ↓ | Shrinkage in Dia., % | 10.80 | 10.47 | 9.30 | 13.95 | 12.40 |
| | | Thermally Agglomerated Powder | | | | | |
| 1600 | 5.5 | Sp. Capacity, μfv/g | 11,340 | 8978 | 9118 | 8260 | 8055 |
| ↓ | ↓ | DCL, μa/g | 2.48 | 2.9 | 2.75 | 2.41 | 3.02 |
| ↓ | ↓ | Dissipation Factor, % | 27.75 | 19.70 | 19.0 | 32.0 | 13.50 |
| ↓ | ↓ | Shrinkage in Dia., % | 3.76 | 3.29 | 2.82 | 4.69 | 4.93 |
| 1600 | 6.5 | Sp. Capacity, μfv/g | 10,604 | 8409 | 8577 | 7590 | 7273 |
| ↓ | ↓ | DCL, μa/g | 2.00 | 3.56 | 4.59 | 1.45 | 2.66 |
| ↓ | ↓ | Dissipation Factor, % | 29.9 | 33.08 | 33.38 | 34.2 | 36.15 |
| ↓ | ↓ | Shrinkage in Dia., % | 3.06 | 3.29 | 2.82 | 3.99 | 4.46 |
| 1800 | 5.5 | Sp. Capacity, μfv/g | 6271 | 5690 | 5775 | 4848 | 5201 |
| ↓ | ↓ | DCL, μa/g | 3.85 | 6.77 | 7.2 | 4.84 | 2.53 |

TABLE III-continued

ELECTRICAL PROPERTIES OF AS-REDUCED AND THERMALLY AGGLOMERATED POWDERS OF EXAMPLE 1

| Test Conditions: Sintering Temp., °C. | Pressed Density, g/cm³ | Electrical Property | Run No. A | B | C | D | E |
|---|---|---|---|---|---|---|---|
| ↓ | ↓ | Dissipation Factor, % | 12.5 | 10.2 | 10.0 | 17.26 | 6.15 |
| ↓ | ↓ | Shrinkage in Dia., % | 10.33 | 8.92 | 8.47 | 10.56 | 9.39 |
| 1800 | 6.5 | Sp. Capacity, μfv/g | 5532 | 5197 | 5184 | 4606 | 4503 |
| ↓ | ↓ | DCL, μa/g | 2.05 | 3.64 | 6.68 | 3.63 | 3.62 |
| ↓ | ↓ | Dissipation Factor, % | 18.0 | 17.7 | 17.7 | 21.65 | 18.0 |
| ↓ | ↓ | Shrinkage in Dia., % | 8.92 | 8.92 | 8.45 | 9.16 | 8.22 |

TABLE IV

BREAKDOWN VOLTAGE OF THERMALLY AGGLOMERATED POWDERS OF EXAMPLE 1 (anode pressed density 6.5 g/cm³, vacuum sintered 30 min. at 1650° C.)

| Run No. | Mean Breakdown Voltage, |
|---|---|
| A | 288 |
| B | 275 |
| C | 280 |
| D | 291 |
| E | 295 |

The Runs A, B, and C in the foregoing TABLES are hereafter referred to as "in-situ doped." Run A, which had been doped with 104 ppm P on a tantalum metal basis retained about 15 ppm P (range of 19 to 11, or 15±4 ppm) as-reduced and thermally agglomerated powders, while in-situ doped Runs B and C, to which 26 ppm P had been added, retained about 4 ppm (range of 7 to 2 ppm).

Thermal agglomeration resulted in a substantial improvement in green strength compared to as-reduced powder, as expected from prior art.

The in-situ doping with phosphorus resulted in substantially higher capacitance at both the 1600° and 1800° C. sintering temperatures compared to the undoped control powders. The higher level of in-situ phosphorus in Run A resulted in up to about 37% higher capacitance. The lower phosphorus in-situ doped Runs B and C resulted in intermediate gains.

The breakdown voltage of the in-situ doped powders sintered at 1650 C. for 30 min. was essentially the same as that of the undoped control powders since the variability of the test itself is about±14 volts. Breakdown voltage is an electrical parameter that is important for some higher voltage applications, but is not considered so for many lower voltage uses. However, the attainment of the highest possible specific capacity in a powder is often a much sought objective. Therefore, the large increase in specific capacity accompanied by essentially no significant decrease in breakdown voltage results in an attractive combination of properties for in-situ doped powders of this invention.

EXAMPLE 2

This example demonstrates that doping with phosphorus can be done at an earlier point within the chemical process used for extracting and recovering tantalum from its ores. In a present state-of-the-art process, tantalum ores, including tantalite and other tantalum-bearing ores, tin slags, and concentrates of these, are digested in hydrofluoric acid to dissolve the tantalum and niobium (columbium) values. Then these values are selectively stripped from the appropriately acidified aqueous solution and separated from each other in a liquid-liquid process using methyl isobutyl ketone (MIBK) or other suitable organic solvent. The resulting purified tantalum-bearing solution from this process, which can be an aqueous stream and called the tantalum raffinate, can be treated with potassium fluoride or hydroxide, or other suitable potassium-containing salt, to recover the tantalum in the form of potassium tantalum fluoride, $K_2TaF_7$.

In other embodiments of this invention, phosphorus additions in the form of appropriate compounds can be introduced into the chemical process at selected stages. This example covers doping of the tantalum (raffinate) product stream (after the liquid-liquid extraction process) with phosphorus. A portion of the phosphorus is retained through the subsequent process steps to provide phosphorus doping of the final resulting sodium reduced tantalum powder.

Phosphorus doped $K_2TaF_7$ was prepared from five different tantalum raffinates containing different concentrations of dissolved tatalum. The $K_2TaF_7$ was precipitated by $K_3PO_4$ additions. The resulting phosphorus values determined by chemical analysis of the $K_2TaF_7$ on the basis of $K_2TaF_7$ and also on a calculated contained tantalum metal basis were:

| | % P by Weight on Basis of | |
|---|---|---|
| Run No. | $K_2TaF_7$ | Ta (Elemental) |
| R-1 | 0.30 | 0.65 |
| R-2 | .22 | .48 |
| R-3 | .07 | .15 |
| R-4 | .18 | .39 |
| R-5 | .15 | .33 |

EXAMPLE 3

The aforementioned U.S. Pat. No. 4,009,007 (Fry) teaches the improved specific capacity that can be obtained in tantalum powder by an added phosphorus containing material in an amount equivalent to from about 5 to about 400 ppm elemental phosphorus. Fry further teaches a method in which the phosphorus-containing material is added to the tantalum powder or tantalum hydride powder.

In contrast, in the in-situ doping method of this invention a phosphorus-containing material is added earlier in the tantalum process before or during creation of the tantalum powder, not after the powder already exists, as in the Fry patent.

In this example the characteristics of the in-situ doped powders are compared to powders doped according to Fry. A matrix experiment was performed to match capacitance levels achieved by the two methods, and then compare the amounts of residual phosphorus required to achieve the specific capacity level, and also other properties and characteristics of the powders. Samples of two as-reduced, undoped tantalum powders designated F and G and having FSSS of 2.4 and 3.2 uM were doped with di-ammonium phosphate to provide additions of none (control), 5, 10, 15, 20, 25, 35 and 50 ppm contained phosphorus on a tantalum metal basis. These powders were thermally agglomerated at 1350° C. for 30 min. and tested using the methods described in Example 1. These data are shown in TABLES V and VI.

In TABLE V, data are shown for thermally agglomerated powders prepared from as-reduced (precursor) powders having a FSSS of 2.4 uM. For the anodes sintered at 1600° C., the specific capacity of the in-situ doped powder was higher than all of the powders doped by the Fry method even though the 11 ppm residual phosphorus content in the in-situ doped powder was intermediate that of the residual levels in the Fry doped powders. For the anodes sintered at 1800 C., the same trends can be seen.

In TABLE VI, data are shown for thermally agglomerated powders prepared from somewhat coarser as-reduced precursor powders having a FSSS of 3.2 uM. For the anodes sintered at either 1600° C. or at 1800° C., the in-situ doped powders containing on the order of 4 to 7 ppm residual phosphorus provide specific capacity values achieved generally only at substantially higher residual phosphorus levels in the powders doped by the Fry method.

All other electrical properties listed appear satisfactory for all of the powders listed in these tables.

The green strength data included in both TABLES V and VI show that powders doped by the Fry method and in-situ doped powders have similar compacted (unsintered) strength when pressed at any selected density.

TABLE V

COMPARISON OF CHARACTERISTICS OF THERMALLY AGGLOMERATED TANTALUM POWDERS PRODUCED FROM AS-REDUCED POWDER WITH FSSS OF ABOUT 2.4 μM

| | Run No. | | | | | | | | | |
|---|---|---|---|---|---|---|---|---|---|---|
| | $F_0$ | $F_1$ | $F_2$ | $F_3$ | $F_4$ | $F_5$ | $F_6$ | $F_7$ | D | A |
| FSSS, μM | | | | | | | | | | |
| As-reduced Powder | 2.4 | → | → | → | → | → | → | → | 2.37 | 2.45 |
| Phosphorus, ppm | | | | | | | | | | |
| Added | 0 | 5 | 10 | 15 | 20 | 25 | 35 | 50 | 0 | 104 |
| Retained | 2 | 4 | 11 | 11 | 11 | 21 | 11 | 21 | ND* | 11 |
| Anode Pressed Density, g/cm³ | 6.5 | → | → | → | → | → | → | → | 6.5 | 6.5 |
| | Sintered 30 min. @ 1600° C. | | | | | | | | | |
| Sp. Cap., μfv/g | 7401 | 7852 | 8077 | 8548 | 8620 | 8943 | 9272 | 9718 | 7590 | 10,604 |
| DCL, μa/g | 1.22 | 1.72 | 1.48 | 1.57 | 2.45 | 4.64 | 1.96 | 1.23 | 1.45 | 2.00 |
| Diss. Factor, % | 23.6 | 30.0 | 24.2 | 32.0 | 28.3 | 27.5 | 29.3 | 24.8 | 34.2 | 29.9 |
| Dia. Shrink., % | 7.04 | 6.57 | 6.10 | 5.87 | 5.16 | 5.16 | 9.86 | 4.69 | 3.99 | 3.06 |

TABLE V-continued

COMPARISON OF CHARACTERISTICS OF THERMALLY AGGLOMERATED TANTALUM POWDERS PRODUCED FROM AS-REDUCED POWDER WITH FSSS OF ABOUT 2.4 μM

| | Run No. | | | | | | | | | |
|---|---|---|---|---|---|---|---|---|---|---|
| | $F_0$ | $F_1$ | $F_2$ | $F_3$ | $F_4$ | $F_5$ | $F_6$ | $F_7$ | D | A |
| | Sintered 30 min. @ 1800° C. | | | | | | | | | |
| Sp. Cap., μfv/g | 4309 | 4341 | 4691 | 4759 | 4886 | 4988 | 5226 | 5005 | 4606 | 5532 |
| DCL, μa/g | 2.44 | 1.97 | 2.31 | 1.47 | 1.71 | 1.96 | 2.16 | 2.21 | 3.63 | 2.05 |
| Diss. Factor, % | 15.8 | 14.0 | 11.4 | 13.9 | 14.3 | 14.8 | 14.5 | 12.6 | 21.6 | 18.0 |
| Dia. Shrink., % | 11.03 | 10.91 | 10.65 | 11.51 | 10.8 | 10.3 | 4.9 | 9.8 | 9.16 | 8.92 |
| | Green Strength, lb. | | | | | | | | | |
| Pressed Density, g/cm$^3$ | | | | | | | | | | |
| 4.5 | 11.5 | 8.0 | 5.0 | 10.5 | 8.0 | 8.5 | 12.0 | 8.6 | 13.1 | 5.8 |
| 5.0 | 21.6 | 14.8 | 14.5 | 18.5 | 15.0 | 18.0 | 21.0 | 19.0 | 23.8 | 12.0 |
| 5.5 | 36.0 | 22.0 | 24.0 | 32.0 | 27.1 | 30.5 | 34.0 | 32.0 | 42.0 | 20.0 |

*ND — Not determined

TABLE VI

COMPARISON OF CHARACTERISTICS OF THERMALLY AGGLOMERATED TANTALUM POWDERS PRODUCED FROM AS-REDUCED POWDER WITH FSSS OF ABOUT 3.2 μM

| | Run No. | | | | | | | | | | |
|---|---|---|---|---|---|---|---|---|---|---|---|
| | $G_0$ | $G_1$ | $G_2$ | $G_3$ | $G_4$ | $G_5$ | $G_6$ | $G_7$ | E | B | C |
| FSSS, μM As-reduced Powder | 3.2 | → | → | → | → | → | → | → | 3.21 | 3.21 | 3.18 |
| Phosphorus, ppm | | | | | | | | | | | |
| Added | 0 | 5 | 10 | 15 | 20 | 25 | 35 | 50 | 0 | 25 | 25 |
| Retained | 2 | 9 | 11 | 11 | 7 | 21 | 41 | 41 | ND* | 7 | 4 |
| Anode Pressed Density, g/cm$^3$ | 6.5 | → | → | → | → | → | → | → | 6.5 | 6.5 | 6.5 |
| | Sintered 30 min. @ 1600° C. | | | | | | | | | | |
| Sp. Cap., μfv/g | 7234 | 7730 | 8097 | 8151 | 8258 | 8513 | 8784 | 8892 | 7273 | 8409 | 8577 |
| DCL, μa/g | 1.08 | 1.46 | 1.47 | 2.01 | 3.18 | 2.45 | 2.22 | 14.7 | 2.66 | 3.56 | 4.59 |
| Diss. Factor, % | 23.6 | 25.4 | 25.2 | 26.8 | 23.5 | 24.1 | 24.6 | 21.4 | 36.15 | 33.08 | 33.38 |
| Dia. Shrink., % | 5.16 | 4.69 | 3.63 | 3.76 | 3.28 | 3.17 | 3.29 | 3.06 | 4.46 | 3.29 | 2.82 |
| | Sintered 30 min. @ 1800° C. | | | | | | | | | | |
| Sp. Cap., μfv/g | 4709 | 4909 | 5137 | 5011 | 5196 | 5271 | 5331 | 5230 | 4503 | 5197 | 5184 |
| DCL, μa/g | 3.95 | 4.90 | 4.40 | 2.94 | 3.92 | 4.42 | 4.18 | 2.60 | 3.62 | 3.64 | 6.68 |
| Diss. Factor, % | 11.4 | 9.6 | 11.8 | 11.0 | 11.0 | 11.4 | 11.4 | 9.6 | 18.0 | 17.7 | 17.7 |
| Dia. Shrink., % | 9.16 | 7.86 | 7.72 | 8.69 | 8.22 | 7.72 | 3.29 | 7.39 | 8.22 | 8.92 | 8.45 |
| | Green Strength, lb. | | | | | | | | | | |
| Pressed Density, g/cm$^3$ | | | | | | | | | | | |
| 4.5 | 9.0 | 9.0 | 9.3 | 4.7 | 7.1 | 8.0 | 10.0 | 8.7 | 7.9 | 5.1 | 10.5 |
| 5.0 | 18.5 | 19.6 | 17.0 | 13.0 | 14.5 | 14.8 | 19.9 | 18.5 | 14.5 | 10.5 | 20.0 |
| 5.5 | 32.0 | 32.0 | 28.0 | 21.1 | 20.0 | 27.0 | 33.0 | 32.0 | 24.3 | 20.0 | 32.0 |

*ND — not determined

EXAMPLE 4

This Example illustrates the effects of combining in situ phosphorus addition with further phosphorus addition after the tantalum powder has formed.

Diammonium phosphate in crystal form was added to samples of as-reduced tantalum powders from Runs B and C of Example 1 in amounts to provide 50 ppm of elemental phosphorus. The mixtures were dry blended, and then thermally agglomerated and tested for electrical properties and green strength as described in Example 1. The data are shown in TABLE VII. Comparing the results with those for thermally agglomerated, in situ doping alone as in powders of Runs B and C in TABLE III, and for final powder doping alone as in Columns $G_0$–$G_7$ in TABLE VI, the combined method resulted in higher specific capacity for anodes pressed at comparable green densities and sintered either at 1600 C. or 1800 C. Other electrical properties were satisfactory, as was green strength.

TABLE VII

ELECTRICAL PROPERTIES AND GREEN STRENGTH OF IN-SITU AS-REDUCED POWDERS FURTHER DOPED WITH 50 ppm ADDED PHOSPHORUS VIA FRY METHOD AND THERMALLY AGGLOMERATED

| Test Conditions | | | | | Green Strength | | | |
|---|---|---|---|---|---|---|---|---|
| | | | | | | Pressed Density, g/cm³ | | |
| Sintering Temp., °C. | Pressed Density, g/cm³ | Electrical Property | Run No. B | Run No. C | Run No. | 4.5 | 5.0 | 5.5 |
| 1600 | 5.5 | Sp. Capacity, μfv/g | 9918 | 10,567 | B | 4.5 | 20.0 | ND |
| ↓ | ↓ | DCL, μa/g | 2.53 | 4.77 | C | 4.5 | 12.0 | ND |
| ↓ | ↓ | Dissipation Factor, % | 30.55 | 33.0 | | | | |
| ↓ | ↓ | Shrinkage in Dia., % | 2.59 | 3.29 | | | | |
| 1600 | 6.5 | Sp. Capacity, μfv/g | 9117 | 9687 | | | | |
| ↓ | ↓ | DCL, μa/g | 2.68 | 3.91 | | | | |
| ↓ | ↓ | Dissipation Factor, % | 35.26 | 38.90 | | | | |
| ↓ | ↓ | Shrinkage in Dia., % | 2.59 | 2.82 | | | | |
| 1800 | 5.5 | Sp. Capacity, μfv/g | 6393 | NA | | | | |
| ↓ | ↓ | DCL, μa/g | 3.15 | NA | | | | |
| ↓ | ↓ | Dissipation Factor, % | 11.36 | NA | | | | |
| ↓ | ↓ | Shrinkage in Dia., % | 7.98 | 8.69 | | | | |
| 1800 | 6.5 | Sp. Capacity, μfv/g | 5787 | 5848 | | | | |
| ↓ | ↓ | DCL, μa/g | 1.84 | 1.58 | | | | |
| ↓ | ↓ | Dissipation Factor, % | 14.45 | 15.20 | | | | |
| ↓ | ↓ | Shrinkage in Dia., % | 7.04 | 7.25 | | | | |

ND = Not determined

What is claimed is:

1. In the process for making tantalum powder wherein (1) a tantalum-containing material is digested in hydrofluoric acid to dissolve tantalum values and other materials in a hydrofluoric acid solution, (2) tantalum is separated from other materials by extraction of said solution with an organic solvent in a liquid-liquid solvent extraction process and a tantalum-rich solution is recovered therefrom, (3) said tantalum-rich solution is treated to precipitate a tantalum salt, (4) said tantalum salt is reduced to metallic tantalum by an alkali metal, and (5) metallic tantalum is recovered from said reduction step in the form of a powder, the improvement wherein a phosphorus-containing material is added to at least one of said steps (3) and (4) in an amount of at least 5 parts of elemental phosphorus per million parts of elemental tantalum at the step of said addition and an amount to provide from about 2 to about 400 parts of elemental phosphorus per million parts of elemental tantalum in the final powder.

2. The method of claim 1 wherein said phosphorus-containing material is added to said tantalum-rich solution prior to the precipitation of said tantalum salt therefrom.

3. The method of claim 1 wherein said phosphorus-containing material is added to said tantalum-rich solution during the precipitation of said tantalum salt therefrom.

4. The method of claim 1 wherein said phosphorus-containing material is charged with said tantalum salt into a reaction vessel into which an alkali metal is added.

5. The method of claim 1 wherein said phosphorus-containing material is an inorganic phosphorus-containing salt.

6. The method of claim 5 wherein said phosphorus-containing salt is an alkali metal salt.

7. The method of claim 5 wherein said salt is free of metallic ions.

8. The method of claim 1 wherein said addition of phosphorus-containing material comprises the only addition of phosphorus-containing material to said tantalum.

9. The method of claim 1 wherein additional phosphorus-containing material is added to said tantalum powder subsequent to said step (5).

10. The tantalum powder produced by the method of claim 1.

11. The tantalum powder produced by the method of claim 8.

12. The tantalum powder produced by the method of claim 9.

* * * * *

Disclaimer 4,356,028.—*Victor T. Bates,* Kenosha, Wis. IN SITU PHOSPHORUS ADDITION TO TANTALUM. Patent dated Oct. 26, 1982. Disclaimer filed Oct. 7, 1983, by the assignee, *Fansteel Inc.*

Hereby enters this disclaimer to claims 2 and 3 of said patent.

[*Official Gazette June 17, 1986.*]